US008096239B2

(12) United States Patent
Gelbart

(10) Patent No.: US 8,096,239 B2
(45) Date of Patent: Jan. 17, 2012

(54) REGISTERING PRINTING SLEEVE SEGMENTS

(75) Inventor: Daniel Gelbart, Vancouver (CA)

(73) Assignee: Eastman Kodak Company, Rochester, NY (US)

( * ) Notice: Subject to any disclaimer, the term of this patent is extended or adjusted under 35 U.S.C. 154(b) by 658 days.

(21) Appl. No.: 11/782,111

(22) Filed: Jul. 24, 2007

(65) Prior Publication Data

US 2009/0025592 A1 Jan. 29, 2009

(51) Int. Cl.
*B41F 13/10* (2006.01)

(52) U.S. Cl. ..... 101/375; 101/485; 101/482; 101/479; 101/401.2; 101/401.1

(58) Field of Classification Search ..... 101/375, 101/485, 482, 486, 479, 401.1, 401.2, 385; 492/40, 48, 56
See application file for complete search history.

(56) References Cited

U.S. PATENT DOCUMENTS 4,353,271 A 10/1982 Pieczulewski
5,778,779 A 7/1998 Jones et al.
5,974,972 A 11/1999 Van Denend et al.
6,116,135 A * 9/2000 Wagner ..... 83/698.42
6,796,234 B1 9/2004 Busshoff
6,820,529 B2 * 11/2004 Elia et al. ..... 83/659
6,843,762 B2 * 1/2005 Munche et al. ..... 492/40
6,886,464 B2 * 5/2005 Inoue et al. ..... 101/485
7,171,901 B2 * 2/2007 Salvestro ..... 101/401.1
2004/0187721 A1 9/2004 Salvestro

FOREIGN PATENT DOCUMENTS

EP 1 013 467 A2 6/2000

OTHER PUBLICATIONS www.ulooptics.com.
www.synrad.com.

* cited by examiner

*Primary Examiner* — Matthew G Marini
(74) *Attorney, Agent, or Firm* — Nelson Adrian Bush

(57) ABSTRACT

A printing sleeve (10) has a first printing sleeve portion (10A) with a first and a second end. At least one of the ends of the first printing sleeve portion has a plurality of projections (16) and notches (18). A second printing sleeve portion (10B) has a first and second end, and least one of the ends has a plurality of projections and notches. The plurality of projections and notches of the first printing sleeve portion interlocks with the plurality of projections and notches of the second printing sleeve portion.

3 Claims, 2 Drawing Sheets

REGISTERING PRINTING SLEEVE SEGMENTS

FIELD OF THE INVENTION

The invention relates to printing sleeves for printing. The invention may be applied to flexographic printing sleeves, for example.

BACKGROUND OF THE INVENTION

In the art of flexographic printing there is a strong desire to use printing sleeves. Printing sleeves offer better register and faster changeovers than plates that are directly mounted onto a press cylinder. Various imaging systems are used to form images on printing sleeves. For example, computer-to-plate systems (also known as CTP systems) are used to form images on printing sleeves. A plurality of imaged printing sleeves is subsequently provided to a printing press to create various printed articles. Each article typically includes a plurality of images. It is important that the plurality of images be accurately aligned with respect to one another to ensure accurate registration.

One challenge associated with the use of printing sleeves is the need to replace the entire sleeve when one part of the sleeve needs to be changed. Portions of printing sleeves may require replacement for various reasons. For example, various portions of the printable surface of a printing sleeve may require replacement due to wear or damage to those portions. A portion may also be changed because of a desire to change the image content of that portion. When printing plates are directly mounted onto press cylinders, a desired portion can be readily separated and replaced. This is not easily done with printing sleeves, especially with printing sleeves that include continuous printable surfaces. One possible solution is to divide the printing sleeve into a plurality of segments which are mounted onto the press cylinder. However, the registration requirements that are required by a printing operation makes it difficult to replace a given sleeve segment and maintain registration.

There remains a need for a printing sleeve made up of a plurality of segments that can be mounted on and demounted from a print cylinder while maintaining a required registration of the printing operation.

There is also a need for effective and practical methods of making a printing sleeve that includes segments that can be replaced on-press without adversely impacting print registration.

SUMMARY OF THE INVENTION

Briefly, according to one aspect of the present invention, a printing sleeve comprises a first printing sleeve portion having a first and a second end, wherein a least one of the ends of the first printing sleeve portion comprises a plurality of projections and notches; a second printing sleeve portion having a first and second end wherein at least one of the ends comprises a plurality of projections and notches; and wherein the plurality of projections and notches of the first printing sleeve portion interlocks with the plurality of projections and notches of the second printing sleeve portion.

BRIEF DESCRIPTION OF THE DRAWINGS

Embodiments and applications of the invention are illustrated by the attached non-limiting drawings. The attached drawings are for purposes of illustrating the concepts of the invention and may not be to scale.

DETAILED DESCRIPTION OF THE INVENTION

Throughout the following description specific details are presented to provide a more thorough understanding to persons skilled in the art. However, well-known elements may not have been shown or described in detail to avoid unnecessarily obscuring the disclosure. Accordingly, the description and drawings are to be regarded in an illustrative, rather than a restrictive, sense.

Dividing a printing sleeve into various portions requires angular accuracy to maintain print registration. The required degree of accuracy is presently difficult to achieve without the use of time consuming optical registration methods. The present invention replaces this time consuming process with a self registering process, based on the averaging effect of patterns made up of a number of interlocking features. This increased accuracy can be generated by a plurality of mating projections and notches (e.g. teeth and recesses) that are disposed at the mating surfaces of the coupled sleeve portions. This accuracy arises because inaccuracies associated with individual projections or notches are averaged over the entire plurality of mating projections and notches. Such arrangements of projections and notches are sometimes used by Hirth couplings or Curvic couplings in machine tool applications. See, for example, U.S. Pat. No. 4,353,271. The potential accuracy of this form of coupling can be demonstrated by the Moore 1440 Index, which operates on this principle and has better than 0.1 arc second accuracy.

Printing sleeves such as flexographic printing sleeves typically include polymer or thin metal core layers that are coated with a layer of modifiable material. The modifiable material is changed in an imagewise fashion as part of a process used to produce a printable surface of the printing sleeve. The modifiable layer can include various polymers and can be modified in various ways to produce a printable surface. For example, photopolymers are typically imagewise exposed with radiation (e.g. actinic radiation) and additionally processed via conventional thermal or chemical techniques to produce printable and non-printable areas. Modifiable materials can be ablated to form a printable surface. Various masks can be used to help define printable and non-printable areas. For example, a mask can be part of a separate film that is superimposed onto the modifiable layer during its exposure. Alternatively, the mask may be an integral component of the printing sleeve. A printing sleeve can also include various layers.

Figure 1:
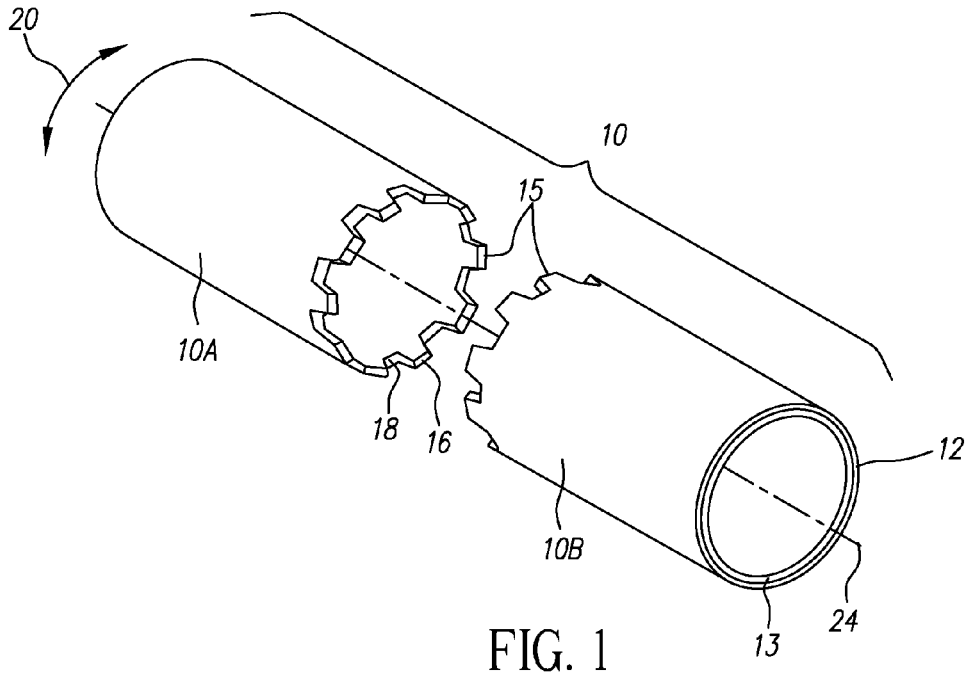
FIG. 1 shows one example embodiment of a printing sleeve according to the present invention.

FIG. 1 shows a printing sleeve 10 that includes multiple separate sleeve portions 10A and 10B as per an example embodiment of the invention. Printing sleeves typically include a hollow, substantially cylindrical layer. In this example embodiment of the invention, printing sleeve 10 includes a core layer 13 and modifiable layer 12. Core layer 13 is generally stiffer and more dimensionally stable than modifiable layer 12 and provides a good structure with which to establish the required registration accuracy. Each of core layer 13 and modifiable layer 12 can include one or more layers. For example, core layer 13 can include various cushion layers to achieve a desired print effect or other various layers to establish a desired print size known in the art as a print repeat. Each of core layer 13 and modifiable layer 12 can be made up of different component parts. For example, core layer 13 can include fiberglass. Modifiable layer 12 can include additional mask layers.

Sleeve portion 10A is coupled to sleeve portion 10B by a pattern 15 of interlocking features including projections 16 and notches 18. In this example embodiment of the invention, projections 16 and notches 18 are arranged along a circumferential direction 20 of printing sleeve 10. In this example embodiment of the invention, projections 16 and notches 18 are integrally formed into sleeve portions 10A and 10B. In some example embodiments, projections 16 and notches 18 are formed on both ends of a sleeve portion to allow it to be interlocked with a plurality of additional sleeve portions.

Figure 2A:
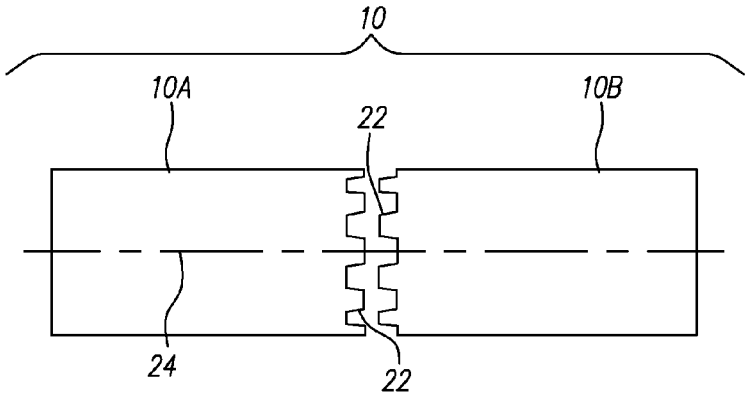
FIG. 2A shows a plan view of the printing sleeve of FIG. 1.
Figure 2B:
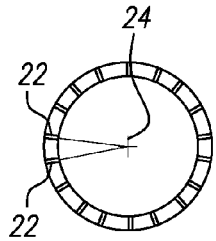
FIG. 2B shows an end view of the printing sleeve of FIG. 1.

FIGS. 2A and 2B show various views of sleeve potions 10A and 10B of FIG. 1. In this example embodiment of the invention, projections 16 and notches 18 are "tapered" interlocking features. Tapered interlocking features can include various shapes such as rounded, triangular or trapezoidal shapes. Tapered interlocking features can be used to reduce clearances between the sleeve portions 10A and 10B when they are coupled. This is especially relevant when pattern 15 is cut into printing sleeve 10 to form segments corresponding to sleeve portions 10A and 10B. Tapered interlocking features can be used to compensate for the kerf of the cut used to form the segments. A "rectangular" or non-tapered feature profile would have angular "play" equal to twice the kerf. Although tapered interlocking features will also cause sleeve portions 10A and 10B to move closer to one another after cutting by an amount proportional to the kerf, registration is still maintained.

Tapered interlocking features can be used to provide increased surface areas between corresponding interlocked projections 16 and notches 18. Larger surface areas can be used to reduce stresses between the interlocked sleeve portions when they are used in operation. High stress can damage projections 16 and notches 18 which can adversely affect the registration accuracy required between the sleeve portions. Interlocking surfaces can be tapered in one or more directions. FIGS. 2A and 2B show that tapered projections 16 and notches 18 include surfaces 22 that are skewed to a cylindrical axis 24. FIG. 2B shows that surfaces 22 extend radially inwards towards cylindrical axis 24. Surfaces 22 are coincident with a plane (not shown) that includes cylindrical axis 24.

Other example embodiments of the invention can use projections 16 and notches 18 that include other shapes. In some embodiments interlocking pattern profiles employed in Hirth couplings or Curvex couplings can be used. The choice of shape of a given projection 16 and a corresponding mating notch 18 can be chosen in accordance with the method that is employed to produce these features. Regardless of the manufacturing method used to produce a given projection 16 or notch 18, inaccuracies associated with that method are averaged out by forming a plurality of projections 16 or notches 18.

The number of projections 16 and notches 18 in pattern 15 can vary in accordance with various factors. Factors can include a size characteristic of sleeve 10 such as its diameter. In some example embodiments of the invention, pattern 15 is arranged over at least half of the circumference of printing sleeve 10 to average out inaccuracies associated with each of the formed projections 16 and notches 18 in pattern 15. In some example embodiment of the invention, a first projection 16 can be diametrically opposed from at least one of an additional projection 16 and a notch 18. In some example embodiments of the invention, pattern 15 can comprise a plurality of groups of one or more projections 16 and notches 18.

The plurality of groups can be arranged over at least half of the circumference of printing sleeve 10. Projections 16 and notches 18 can include complimentary shapes. Pattern 15 can include a repeating pattern. Projections 16 and notches 18 can be arranged regularly or irregularly in pattern 15. An irregular pattern 15 can include various projections 16 and notches 18 that have different characteristics than other projections 16 and notches 18 in pattern 15. Different characteristics can include different sizes or shapes or different spacings between adjacent projections or adjacent notches. Irregular patterns 15 can be used to couple a sleeve portion 10A to sleeve portion 10B in a single orientation which can be used to ensure that the portions are correctly assembled with respect to each other.

Figure 4:
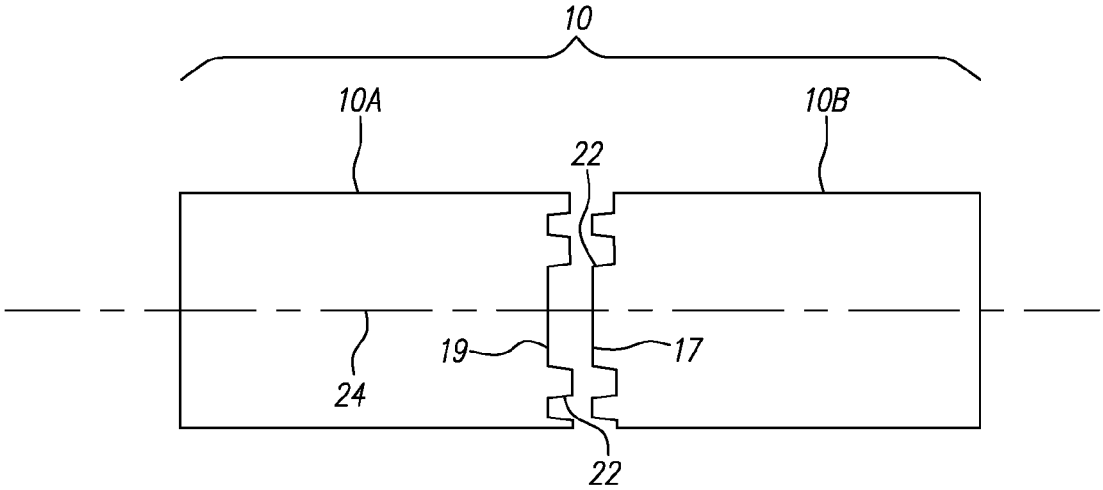
FIG. 4 shows a printing sleeve as per an example embodiment of the invention.

FIG. 4 shows an alignment projection 17 and an alignment notch 19. When a regular pattern of projections 16 and notches 18 are cut to form a pattern 15, there is a possibility of radial misalignment. Using a feature such as alignment projection 17 and alignment notch 19 prevents radial misalignment when joining sleeve portions 10A and 10B.

Sleeve portions 10A and 10B can be formed in various ways. In this example embodiment of the invention, sleeve portions 10A and 10B are made by cutting printing sleeve into various segments. Interlocking pattern 15 is cut into sleeve 10 to form sleeve portions 10A and 10B. Various methods can be used to cut printing sleeve 10. These methods can include laser cutting.

Figure 3:
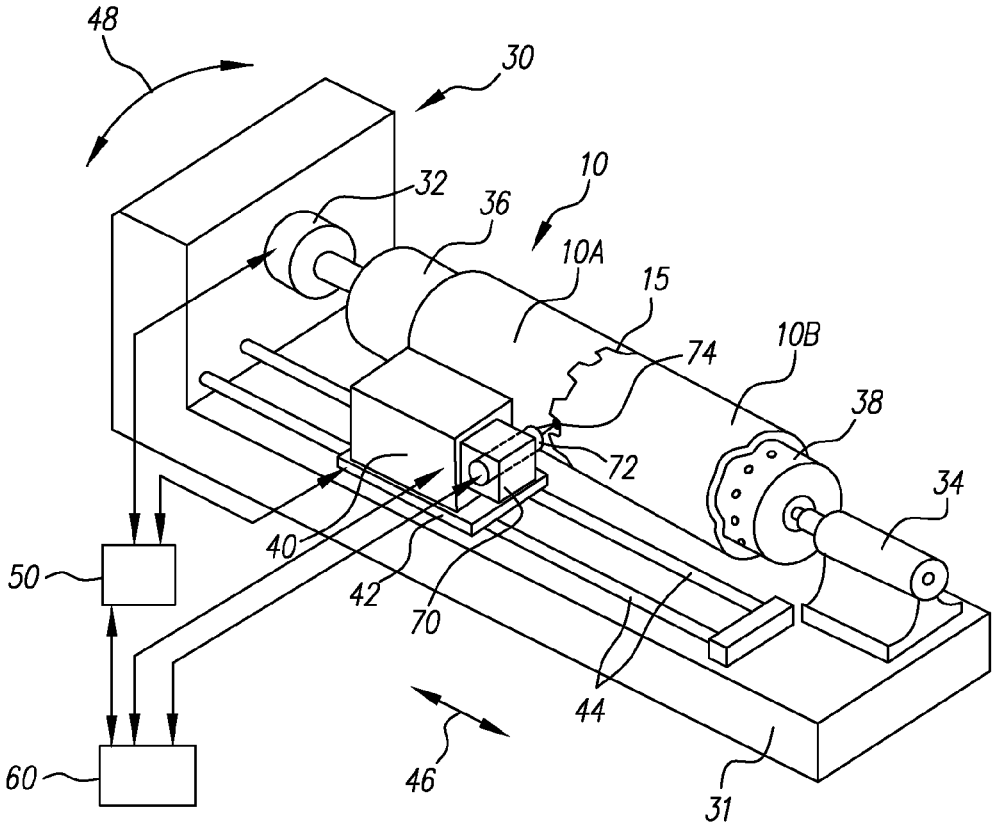
FIG. 3 is a view of an apparatus for making a printing sleeve according to the invention.

FIG. 3 shows a partial schematic view of an apparatus 30 used to form sleeve portions 10A and 10B as per an example embodiment of the invention. In this example embodiment of the invention, apparatus 30 is also used to form images on printing sleeve 10. Computer-to-plate imaging systems such as the Kodak ThermoFlex manufactured by Kodak Graphic Communications Canada Company, British Columbia, Canada have been used to form images on flexographic printing sleeves. Apparatus 30 includes a support 31. Apparatus 30 also includes a headstock 32, tailstock 34 and a sleeve support 36 rotatably coupled between the two. Sleeve support 36 comprises a cylindrical body (e.g. a drum) that accurately fits sleeve 10. Sleeve support 36 is pressurized to facilitate the mounting and demounting of sleeve 10 from sleeve support 36. In this example embodiment of the invention, sleeve support 36 includes ports 38 which allow a pressurize fluid (e.g. air) to expand sleeve 10 to facilitate its mounting or demounting (sleeve portion 10B shown as a partially broken view to show ports 38). Sleeve support 36 can be moved relatively to at least one of headstock 32 and tailstock 34 to assist in the mounting or demounting of printing sleeve 10.

Apparatus 30 includes imaging head 40 that is movable with respect to sleeve support 36. In this example embodiment of the invention, imaging head 40 is mounted on movable carriage 42. Carriage 42 is moved along guides 44 to cause imaging head 40 to be moved along a path aligned with an axis of the cylindrical sleeve support 36. In this example embodiment of the invention, imaging head 40 moves along a path aligned with sub-scan axis 46. Motion system 50 is used to provide relative motion between imaging head 40 and sleeve support 36. Motion system 50 (which can include one or more motion systems) includes any suitable prime movers and transmission members needed for the required motion. In this example embodiment of the invention, motion system 50 is used to move sleeve support 36 along a path aligned with main-scan axis 48 while moving imaging head 40 along a path aligned with sub-scan axis 46. Separate motion systems can also be used to operate different systems within apparatus 30.

Imaging head 40 includes a radiation source (not shown), such as a laser. Imaging head 40 is controllable to direct one or more imaging beams (not shown) capable of forming image on printing sleeve 10. The imaging beams generated by imaging head 40 are scanned over printing sleeve 10 while being image-wise modulated according to image data representing the image to be written. One or more imaging channels are driven appropriately to produce imaging beams with active intensity levels wherever it is desired to form an image portion. Imaging channels not corresponding to the image portions are driven so as not to image corresponding areas. Images can be formed on printing sleeve 10 by different methods. For example, a property or characteristic of the modifiable layer 12 can be changed when irradiated by an imaging beam. An imaging beam can be used to ablate a surface of printing sleeve 10 to form an image. An imaging beam can be used to facilitate a transfer of an image forming material to a surface of printing sleeve 10 to form an image. Imaging head 40 can include a plurality of channels that can be arranged in an array. An array of imaging channels can include a one dimensional or two dimensional array of imaging channels. An imaging beam can undergo a direct path from a radiation source to printing sleeve 10 or can be deflected by one or more optical elements towards printing sleeve 10.

Controller 60, which can include one or more controllers is used to control one or more systems of apparatus 30 including, but not limited to, various motion systems 50 used by sleeve support 36 and carriage 42. Controller 60 can also control sleeve handling mechanisms that can initiate the loading and/or unloading of printing sleeve 10 to and/or from sleeve support 36. Controller 60 can also provide image data to imaging head 40 and control imaging head 40 to emit imaging beams in accordance with this data. Various systems can be controlled using various control signals and/or implementing various methods. Controller 60 can be configured to execute suitable software and can include one or more data processors, together with suitable hardware, including by way of non-limiting example: accessible memory, logic circuitry, drivers, amplifiers, A/D and D/A converters, input/output ports and the like. Controller 60 can comprise, without limitation, a microprocessor, a computer-on-a-chip, the CPU of a computer or any other suitable microcontroller.

Apparatus 30 includes a sleeve cutter 70. Sleeve cutter 70 can include a radiation source operable for emitting a radiation beam for cutting printing sleeve 10. In this example embodiment of the invention, sleeve cutter 70 includes laser 72, such as a $CO_2$ laser that is mounted on carriage 42. Laser 72 generates spot 74 (exaggerated for the sake of clarity) using a focusing lens (not shown). Imaging head 40 and laser 72 can move towards and away from sleeve support 36 to accommodate different sleeve diameters. Other devices may also be used as sleeve cutter, for example narrow, high pressure water jets.

As stated above, motion system 50 is used to establish relative motion between printing sleeve 10 and imaging head 40 as images are formed on printing sleeve 10. Motion system 50 can also be used to establish relative motion between printing sleeve 10 and laser 72 as printing sleeve 10 is cut into sleeve portions 10A and 10B. Motion system 50 and laser 72 can be controlled by controller 60, or the like to cut printing sleeve 10 in accordance with cutting data provided to the controller.

Figure 2C:
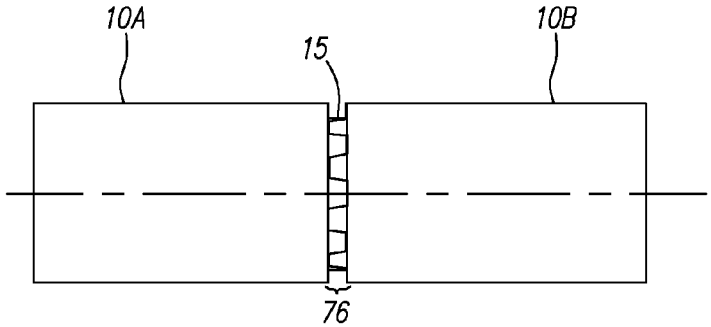
FIG. 2C shows a printing sleeve as per an example embodiment of the invention.

In this example embodiment of the invention, pattern 15 is cut once printing sleeve 10 is mounted on sleeve support 36. When the thickness of modifiable layer 12 is large compared to the thickness of core layer 13, it may be desirable to clear a band 76 (not shown in FIG. 3) in modifiable layer 12 before cutting pattern 15. This can reduce the requirements for the depth of focus on laser 72. The cleared band can follow the shape of pattern 15 or can assume another shape such as the "circumferential" band 76 in FIG. 2C. In some example embodiments of the invention, band 76 is formed with laser 72. In some embodiments of the invention, band 76 is formed by imaging head 40. In some systems, imaging head 40 is used to engrave or ablate modifiable layer 12 to form band 76.

In some example embodiments of the invention, pattern 15 is cut after imaging head 40 forms an image on print sleeve 10. In these embodiments, image data can be modified to account for the kerf of the various cuts so as to properly position images on corresponding sleeve portions 10A and 10B. In other example embodiments of the invention, pattern 15 is cut before imaging head 40 forms an image on print sleeve 10. After cutting, the sleeve potions 10A and 10B can be moved together to abut one another prior to imaging. In this way, a replacement sleeve potion can be made to interchange with an existing sleeve portion with a high degree of accuracy.

Controller 60 can be programmed to form pattern 15. Pattern 15 can be formed in non-image areas. Typically, when printing sleeves are used to print media for packaging applications, bands or "lanes" of images are formed on printing sleeves. Gutters of non-image areas exist between the lanes. A pattern 15 can be formed in these gutters.

Those skilled in the related art will quickly realize that the present invention can also be incorporated into a dedicated sleeve cutting device. Such devices can have a similar construction to apparatus 30, with the obvious exception that imaging head 40 would not be present.

Effective cutting of sleeve 10 can depend on the power and beam quality of the $CO_2$ laser, as well as the focal length and type of focusing lens. Cutting speed is proportional to the power of the laser as well as the composition and thickness of the sleeve. Small sleeves with diameters on the order of 100 mm can be typically cut efficiently with laser power in the order of 100 W, although acceptable cuts may be achieved with powers as low as 20 W. The laser beam quality should be good, with $M^2$ less than 2. The focusing lens is preferably aspheric. Since the desired depth of focus is typically a few millimeters, a lens with an f/# ranging from f/5 to f/10 is suitable. Latitude can be taken with the selection of the focal length of the lens, as the present inventor believes that the cutting is primarily dependant on f/# rather than focal length.

By way of non-limiting example, the following possible configuration is provided. For convenience, a $CO_2$ laser lens with a focal length of 25.4 mm (part number 10ZAL254 from ULO Optics Ltd (www.ulooptics.com)) was selected to be used with a Synrad Evolution 100 100 W laser (www.synrad.com). This particular laser has an $M^2$=1.2 and a 4 mm beam diameter. The effective f/# associated with this combination is about f/6. The theoretical depth of focus is about 1 mm but the actual depth of focus is about 2 mm because of the "self guidance" effect, which is known to those skilled in the art of $CO_2$ laser cutting. The spot size (and associated kerf) is approximately 0.1 mm. Register accuracy of about 10 microns can be achieved using these parameters to cut a pattern 15 with trapezoidal feature profiles with a pitch of about 10 mm and height of about 3 mm. Different core materials including fiberglass were easily cut.

While example embodiments of the invention have employed $CO_2$ lasers, other types of lasers such as laser diodes, or diode pumped YAG lasers can also be used. $CO_2$ lasers can be advantageous since typical sleeve materials respond well to $CO_2$ laser cutting. A $CO_2$ laser can deform or damage a sleeve support onto which the sleeves are mounted during cutting. To minimize potential damage to the sleeve support, the sleeve support can include a heavy polished copper layer (about 1 mm thick). Polished copper reflects most of the $CO_2$ laser radiation and conducts heat well to help reduce the effect of the laser on the sleeve support. An alternative is to use disposable intermediate sleeves (similar to sleeves used to build up print cylinders to a required diameter during printing). Such disposable sleeves can be discarded after a number of cutting jobs. Their longevity can be increased when subsequent cuts are made in different locations.

While a primary function of the described methods and systems is to cut toothed or serrated patterns for registration, it is readily apparent that that the same methods and systems can be used to cut sleeves to length, or cut an end of a sleeve portion that does not require a registration pattern. Cutting sleeves to length prior to use can reduce demands on inventory, as only a few specific lengths need to be stocked.

It is to be understood that the exemplary embodiments of the invention are merely illustrative and that many variations of the described embodiments can be devised by those skilled in the art without departing from the scope of the invention.

PARTS LIST

10 printing sleeve
10A sleeve portion
10B sleeve portion
12 modifiable layer
13 core layer
15 pattern
16 projections
17 alignment projection
18 notches
19 alignment notch
20 circumferential direction
22 surfaces
24 cylindrical axis
30 apparatus
31 support
32 headstock
34 tailstock
36 sleeve support
38 ports
40 imaging head
42 carriage
44 guides
46 sub-scan axis
48 main-scan axis
50 motion system
60 controller
70 sleeve cutter
72 laser
74 spot
76 band

The invention claimed is:

1. A method for printing with a self registering printing sleeve comprising:

mounting the printing sleeve on a sleeve support wherein the printing sleeve comprises a modifiable layer;

cutting the printing sleeve into a plurality of separate and interlocking printing sleeve portions with a radiation beam;

moving the printing sleeve portions together to abut one another;

forming an image on each of the printing sleeve portions with the radiation beam;

printing at least one image with the printing sleeve portions;

removing at least one printing sleeve portion;

replacing the at least one printing sleeve portion with a replacement portion;

aligning interlocking features on the replacement printing sleeve portion with complimentary interlocking features on an adjacent interlocking printing sleeve portion; and moving the replacement printing sleeve portion to abut the adjacent interlocking printing sleeve portion.

2. The method of claim 1 comprising:

printing at least one additional image.

3. The method of claim 2 wherein the interlocking features and complimentary interlocking features on the adjacent interlocking printing sleeve portions are irregular in shape or spacing to prevent to prevent misalignment.

* * * * *